US010400410B2

(12) United States Patent
Cook

(10) Patent No.: US 10,400,410 B2
(45) Date of Patent: Sep. 3, 2019

(54) CONTAINMENT UNIT AND METHOD OF USING SAME

(71) Applicant: MARQUIX, INC., Houston, TX (US)

(72) Inventor: Ronald Cook, Houston, TX (US)

(73) Assignee: Marquix, Inc., Houston, TX (US)

( * ) Notice: Subject to any disclaimer, the term of this patent is extended or adjusted under 35 U.S.C. 154(b) by 0 days.

(21) Appl. No.: 14/932,589

(22) Filed: Nov. 4, 2015

(65) Prior Publication Data

US 2016/0222618 A1 Aug. 4, 2016

Related U.S. Application Data

(63) Continuation of application No. 13/983,259, filed as application No. PCT/US2012/023839 on Feb. 3, 2012, now abandoned.

(60) Provisional application No. 61/439,352, filed on Feb. 3, 2011.

(51) Int. Cl.

| | |
|---|---|
| ***E02B 15/08*** | (2006.01) |
| ***E02B 15/04*** | (2006.01) |
| ***E21B 43/01*** | (2006.01) |
| ***B63B 7/00*** | (2006.01) |
| *B63B 27/34* | (2006.01) |

(Continued)

(52) U.S. Cl.

CPC ..... *E02B 15/0857* (2013.01); *E02B 15/045* (2013.01); *E21B 43/0122* (2013.01); *B63B 27/34* (2013.01); *B63C 7/006* (2013.01); *E02B 2015/005* (2013.01); *E02D 2220/00* (2013.01)

(58) Field of Classification Search

CPC ..... E21B 43/0122; E21B 43/00; E21B 43/01; E21B 43/34; E21B 43/36; E02B 2015/005; E02B 15/0814; E02B 15/08; E02B 17/02; E02B 15/046; E02B 15/042

USPC ..... 405/52, 60, 63, 64, 203, 205, 210

See application file for complete search history.

(56) References Cited

U.S. PATENT DOCUMENTS 3,230,967 A * 1/1966 Castro ..... B65D 88/78 137/236.1

3,245,539 A * 4/1966 Earle ..... B01D 17/0214 210/242.3

(Continued)

FOREIGN PATENT DOCUMENTS

| | | |
|---|---|---|
| FR | 2853673 | 10/2004 |
| WO | WO1981001310 | 5/1981 |

(Continued)

OTHER PUBLICATIONS

Internation Search Report of PCT/US2012/023839 dated Feb. 11, 2013, 3 pages.

*Primary Examiner* — Benjamin F Fiorello
*Assistant Examiner* — Edwin J Toledo-Duran
(74) *Attorney, Agent, or Firm* — Berenato & White, LLC

(57) ABSTRACT

The present invention generally relates to containment and control of an oil spill caused by a damaged or broken riser in deepwater. More specifically, the present invention relates to a reusable unit that will contain oil spills to a specific location and will also allow oil to be harvested as it flows to the top of the unit while minimizing or even eliminating any environmental clean-up cost. The unit of the present invention is dropped over a damaged or broken riser in a closed position, the unit is released and stabilized in sections until the surface is reached and the containment unit is completely erected.

22 Claims, 14 Drawing Sheets

(51) Int. Cl.
*B63C 7/00* (2006.01)
*E02B 15/00* (2006.01)

(56) References Cited

U.S. PATENT DOCUMENTS 3,327,667 A * 6/1967 Manning ..... B63B 9/065 114/256
3,339,512 A * 9/1967 Siegel ..... B65D 88/78 114/257
3,389,559 A * 6/1968 Logan ..... E21B 43/0122 137/312
3,469,402 A * 9/1969 Lowd ..... B65D 88/78 210/923
3,543,422 A * 12/1970 Plutchak ..... E02F 3/905 37/318
3,548,605 A * 12/1970 Armistead ..... E02B 15/08 210/918
3,561,220 A * 2/1971 Riester ..... E02B 15/08 405/60
3,610,194 A * 10/1971 Siegel ..... B65D 88/78 114/257
3,624,702 A * 11/1971 Meheen ..... E02B 17/025 405/227
3,653,215 A * 4/1972 Crucet ..... E21B 43/0122 210/121
3,658,181 A * 4/1972 Blair ..... E21B 43/0122 210/170.05
3,664,136 A * 5/1972 Laval, Jr. ..... E21B 43/0122 405/60
3,666,100 A 5/1972 Madej
3,667,605 A 6/1972 Zielinski
3,674,150 A * 7/1972 Lejeune ..... E21B 43/0122 210/245
3,681,923 A * 8/1972 Hyde ..... E21B 43/0122 210/170.01
3,698,198 A * 10/1972 Phelps ..... E02B 17/025 175/9
3,710,582 A * 1/1973 Hills ..... B65D 88/78 114/257
3,724,662 A * 4/1973 Ortiz ..... E21B 43/0122 210/242.3
3,879,951 A * 4/1975 Mason ..... E21B 43/0122 405/60
3,981,154 A * 9/1976 Hix, Jr. ..... B65D 88/78 405/210
4,047,390 A 9/1977 Boyce, II
4,212,329 A * 7/1980 Horton ..... F03G 7/05 138/155
4,220,207 A * 9/1980 Allen ..... E21B 17/01 166/357
4,229,297 A * 10/1980 Nohmi ..... B01D 17/085 210/654
4,231,873 A * 11/1980 Swigger ..... B65D 88/78 210/170.05
4,283,159 A * 8/1981 Johnson ..... E21B 43/0122 166/364
4,290,714 A * 9/1981 Strange ..... E21B 41/005 210/923
4,293,239 A * 10/1981 Petty ..... E02B 9/00 405/203
4,298,295 A * 11/1981 Bozzo ..... F03G 7/05 405/52
4,318,442 A 3/1982 Lunde et al.
4,350,014 A * 9/1982 Sanchez ..... B63B 35/44 114/264
4,358,218 A * 11/1982 Graham ..... E21B 43/0122 210/922
4,358,219 A * 11/1982 Burns ..... E21B 43/0122 405/195.1
4,373,834 A * 2/1983 Grace ..... E21B 43/0122 405/209
4,382,716 A * 5/1983 Miller ..... E21B 43/0122 405/52
4,395,157 A * 7/1983 Cunningham ..... E21B 43/0122 405/195.1
4,402,632 A * 9/1983 Cook ..... B65D 88/78 114/257
4,405,258 A 9/1983 O'Rourke et al.
4,416,565 A * 11/1983 Ostlund ..... E21B 43/0122 210/170.11
4,421,436 A * 12/1983 Burns ..... B63B 21/502 405/195.1
4,449,850 A * 5/1984 Cessou ..... E21B 41/005 210/923
4,456,071 A * 6/1984 Milgram ..... E21B 43/0122 166/356
4,531,860 A * 7/1985 Barnett ..... E21B 43/0122 210/923
4,568,220 A * 2/1986 Hickey ..... E21B 43/0122 166/338
4,728,224 A 3/1988 Salama et al.
4,944,872 A * 7/1990 Kantor ..... B63B 35/44 210/170.05
5,050,680 A * 9/1991 Diehl ..... E21B 33/037 137/312
5,213,444 A 5/1993 Henning
5,284,213 A * 2/1994 Nobileau ..... E21B 7/12 175/161
5,484,024 A * 1/1996 Ladd ..... E21B 33/08 166/369
5,582,252 A 12/1996 Richmond et al.
6,244,785 B1 * 6/2001 Richter ..... B63B 3/04 114/125
6,554,534 B1 4/2003 Butterfield
6,592,299 B1 * 7/2003 Becker ..... E03B 3/06 405/210
6,609,853 B1 8/2003 Guilmette
7,721,611 B2 5/2010 Salama
7,870,732 B2 * 1/2011 Kuo ..... F16L 1/15 60/641.6
8,016,030 B1 9/2011 Prado Garcia
8,173,012 B1 * 5/2012 Che ..... E21B 43/0122 166/357
8,297,361 B1 * 10/2012 Root ..... E21B 43/0122 166/341
8,517,632 B2 * 8/2013 Later ..... E21B 43/0122 405/210
8,523,482 B1 * 9/2013 Watson, Sr. ..... E21B 43/0122 405/210
9,309,640 B2 * 4/2016 Denning ..... E02B 15/04
9,328,471 B2 * 5/2016 Splittstoesser ..... E02B 15/0807
9,476,411 B2 * 10/2016 Gaigler ..... F16L 1/23
9,506,211 B2 * 11/2016 Losnedal ..... E02B 17/00
2010/0032164 A1 2/2010 Bakke
2010/0038324 A1 2/2010 Couch
2010/0143038 A1 * 6/2010 Cobb ..... E02B 15/0814 405/63
2011/0274495 A1 11/2011 Estes
2011/0274496 A1 11/2011 Dvorak
2011/0293372 A1 * 12/2011 Later ..... E21B 43/0122 405/60
2011/0293377 A1 12/2011 Goulet et al.
2011/0299930 A1 * 12/2011 Messina ..... E21B 7/185 405/60
2011/0318106 A1 * 12/2011 Gateff ..... B63C 7/006 405/60
2011/0318107 A1 * 12/2011 Dighe ..... E21B 43/0122 405/63
2011/0318108 A1 12/2011 Wolinsky
2012/0024384 A1 * 2/2012 Chaddick ..... F17D 1/00 137/1
2012/0024533 A1 * 2/2012 Ivic ..... E21B 43/0122 166/344
2012/0024535 A1 * 2/2012 Lieske, II ..... E21B 43/0122 166/363
2012/0027517 A1 * 2/2012 Shifferaw ..... E21B 43/0122 405/60
2012/0045285 A1 * 2/2012 Hansen ..... E21B 43/0122 405/203
2012/0051841 A1 3/2012 Hatton et al.

(56) References Cited

U.S. PATENT DOCUMENTS

2012/0070231 A1 3/2012 Al-Sharif
2012/0080194 A1* 4/2012 Birdwell ..... E21B 43/0122 166/345
2012/0152560 A1* 6/2012 O'Malley ..... E21B 43/0122 166/345
2012/0155964 A1* 6/2012 Carter ..... E21B 43/0122 405/60
2012/0251244 A1* 10/2012 Toedtman ..... C02F 1/40 405/60
2013/0046126 A1* 2/2013 Varney ..... B63B 35/32 588/260
2013/0084136 A1* 4/2013 Losnedal ..... E02B 17/00 405/204
2013/0108369 A1* 5/2013 Splittstoesser ..... E02B 15/0807 405/63
2013/0195555 A1* 8/2013 Kersten ..... E21B 43/0122 405/65
2013/0236273 A1* 9/2013 Heiler ..... B63B 35/305 414/141.8
2013/0279988 A1* 10/2013 Ai-Buraik ..... F17D 5/02 405/127
2014/0356068 A1* 12/2014 Andritsos ..... B63C 7/006 405/60
2014/0356069 A1* 12/2014 Gateff ..... E02B 15/04 405/60
2015/0197906 A1* 7/2015 Denning ..... E02B 15/04 405/64
2016/0333674 A1* 11/2016 Anderson ..... E02B 15/08
2017/0321524 A1* 11/2017 Vu ..... E21B 43/0122

FOREIGN PATENT DOCUMENTS

WO WO1982001387 4/1982
WO WO1994017251 * 1/1993
WO WO2004092006 10/2004
WO WO2011163239 12/2011
WO WO2012007389 1/2012
WO WO2012020322 2/2012
WO WO2012022277 2/2012
WO WO2012062264 5/2012

* cited by examiner

CONTAINMENT UNIT AND METHOD OF USING SAME

REFERENCE TO RELATED APPLICATION

The present application is a continuation of U.S. patent application Ser. No. 13/983,259, filed Oct. 9, 2013, which is a national stage application of International Application No. PCT/US2012/023839 filed Feb. 3, 2012, which claims the benefit priority of U.S. Provisional Patent Application No. 61/439,352, filed Feb. 3, 2011, of which the disclosures are hereby incorporated by reference and to which priority is claimed.

FIELD OF INVENTION

The present invention relates to oil leaks under water (or similar situations such as gas leaks on land) and means of containing and recovering spilled oil, quickly, efficiently and conveniently thereby minimizing loss of oil and protecting the environment.

BACKGROUND OF INVENTION

For years, the problem of salvaging deep-sea oil leaks has been of great concern. It has long been known that such leaks waste valuable quantities of oil and/or gas, and the oil causes huge environmental problems, both to the sea, beaches, wildlife, etc. The monetary expense and cost to the environment of these spills is staggering.

Great quantities of oil wastage are involved with these spills. For example, in the 1979 tragedy of the Mexican oil well leak in the Bay of Campeche, it was reported that the leak was spewing out more than 10,000 barrels of oil daily, and that in less than three months it had dumped over 2,000,000 barrels of oil into the gulf.

The recent Deepwater Horizon oil spill spilled oil in the Gulf of Mexico for three months in 2010. The impact of the spill continued long after the well was capped. It is the largest accidental marine oil spill in the history of the petroleum industry. On July 15, the leak was stopped by capping the gushing wellhead, but not until after it had released about 4.9 million barrels or 205.8 million gallons of crude oil. It was estimated that 53,000 barrels per day (8,400 $m^3$/d) were escaping from the well just before it was capped. It is believed that the daily flow rate diminished over time, starting at about 62,000 barrels per day (9,900 $m^3$/d) and decreasing as the reservoir of hydrocarbons feeding the gusher was gradually depleted. On September 19, the relief well process was successfully completed, and the federal government declared the well "effectively dead". However, the spill continues to cause extensive damage to marine and wildlife habitats as well as the Gulf's fishing and tourism industries.

In late November 2010, 4,200 square miles (11,000 $km^2$) of the Gulf were re-closed to shrimping after tar balls were found in shrimpers' nets. The total amount of Louisiana shoreline impacted by oil grew from 287 in July to 320 miles (510 km) in late November. In January 2011, eight months after the explosion, an oil spill commissioner reported that tar balls continue to wash up, oil sheen trails are seen in the wake of fishing boats, wetlands marsh grass remains fouled and dying, and that crude oil lies offshore in deep water and in fine silts and sands onshore.

Accordingly, there remains a need to provide a means of containing and recovering spilled oil, quickly, efficiently and conveniently, thereby minimizing loss of oil and protecting the environment.

SUMMARY OF INVENTION

The present invention generally relates to containment and control of an oil spill caused by a damaged or broken riser in deepwater, damaged subsea equipment, or the like. It can also be used for preventative purposes, such as during the drilling cycle.

More specifically, the present invention relates to a reusable unit that will contain oil spills to a specific location and also allow oil to be harvested as it flows to the top of the unit while minimizing or even eliminating any environmental clean-up cost.

An object of the present invention is to provide a containment unit comprising a weighted base, and at least one flotation unit comprising a flotation device and a barrier.

The containment unit of the present invention is dropped over a damaged or broken riser or damaged equipment. The unit is released and stabilized in sections until the surface of the water is reached and the containment unit is completely erected. Alternatively, the sections could be extended to any distance above the mud line, not necessarily to the surface of the water.

It is another object of the present invention to provide a method of using a containment unit, comprising the steps of: a) deploying a compressed containment unit to the ocean floor over a broken riser; b) releasing a first flotation unit; c) releasing subsequent flotation units sequentially at regular increments, preferably 1,000-foot increments, until the ocean surface is reached; and d) anchoring each flotation unit as necessary before releasing a subsequent flotation unit.

There has thus been outlined, rather broadly, the more important features of the invention in order that the detailed description thereof that follows may be better understood, and in order that the present contribution to the art may be better appreciated. There are, of course, additional features of the invention that will be described further hereinafter.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception upon which this disclosure is based may be readily utilized as a basis for the designing of other structures, methods and systems for carrying out the several purposes of the present invention. It is important, therefore, that equivalent constructions insofar as they do not depart from the spirit and scope of the present invention, are included in the present invention.

For a better understanding of the invention, its operating advantages and the aims attained by its uses, references should be had to the accompanying drawings and descriptive matter which illustrate preferred embodiments of the invention.

DETAILED DESCRIPTION OF PREFERRED EMBODIMENTS

Figure 1:
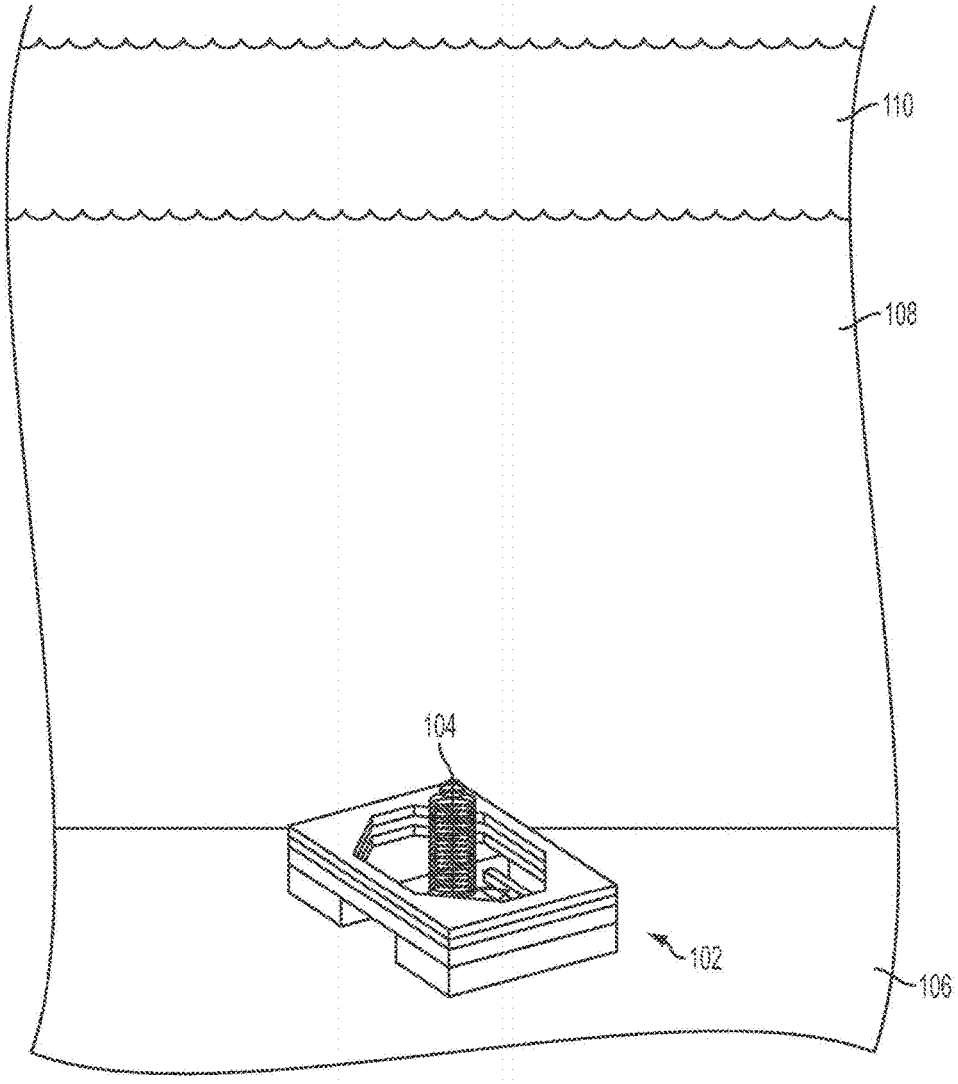
FIGS. 1-6 are schematics depicting the method of using the containment unit of a first preferred embodiment.

Preferred embodiments of the invention will be set forth in detail with reference to the drawings, in which like reference numerals refer to like elements throughout.

The containment unit of the first preferred embodiment is used by having a Remotely Operated Vehicle (ROV) deploy a compressed containment unit to the ocean floor over a broken riser. A first flotation unit is released, and subsequent flotation units are then sequentially released at about 1,000-foot increments until the ocean surface is reached. Each flotation unit is anchored to the ocean floor (preferably up to 3,000 feet from the ocean floor) or to tug boats/barges (preferably over 3,000 feet from the ocean floor) as necessary to stabilize each flotation unit before releasing a subsequent flotation unit.

The result is an erected containment unit comprising multiple flotation units (depending on the depth needed) with flotation devices and Kevlar or rubber walls reinforced with cables, rubber coated cables or solid PVC piping, which keeps the spilled oil in one specific location and does not allow the oil to spread and contaminate the environment. The containment unit of the present invention also allows ships or tankers to draw the oil from the top of the unit.

The process will now be described in greater detail. The specifics of the process are illustrative rather than limiting and can vary as determined by specific needs or conditions.

As shown in FIG. 1, a compressed containment unit 102 containing multiple flotation units, preferably five flotation units (depending on the depth of the water, i.e., 5,000 feet), is placed around a broken or damaged riser 104 on the floor 106 of an ocean, gulf, or other body of salt water 108 having a surface 110.

Figure 2:
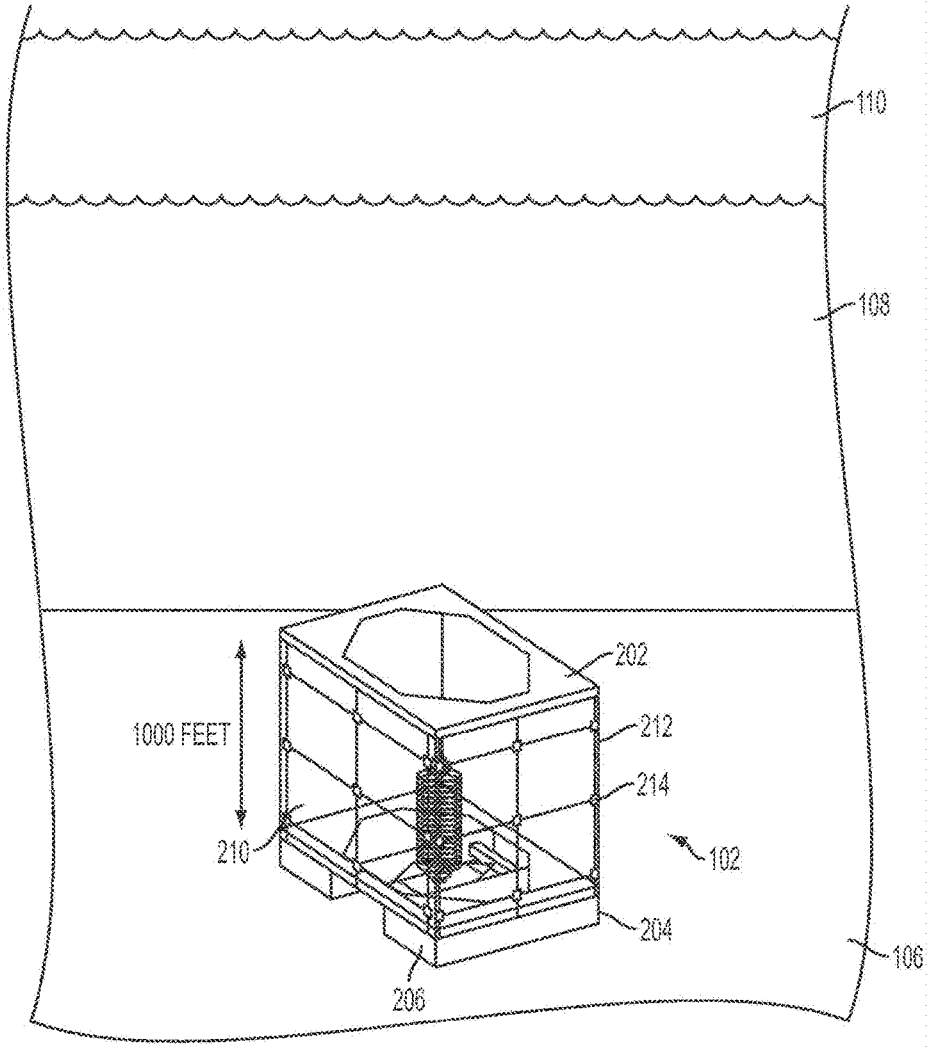

As shown in FIG. 2, the first flotation unit 202 is released. As shown, the base unit 204 is formed from concrete 206 with coated foam flotation devices on top. The first flotation unit 202 also has barrier walls 210 of Kevlar or rubber, reinforced by cables 212 connected by connectors 214. The flotation devices of the flotation unit 202 are made of coated foam braced with metal crossbars, in a manner to be explained below. Second through fourth flotation units 202 are compressed on top of the first flotation unit 202. The flotation unit 202 is 1,000 feet high and has an inner diameter sufficient to accommodate the riser.

Figure 3:
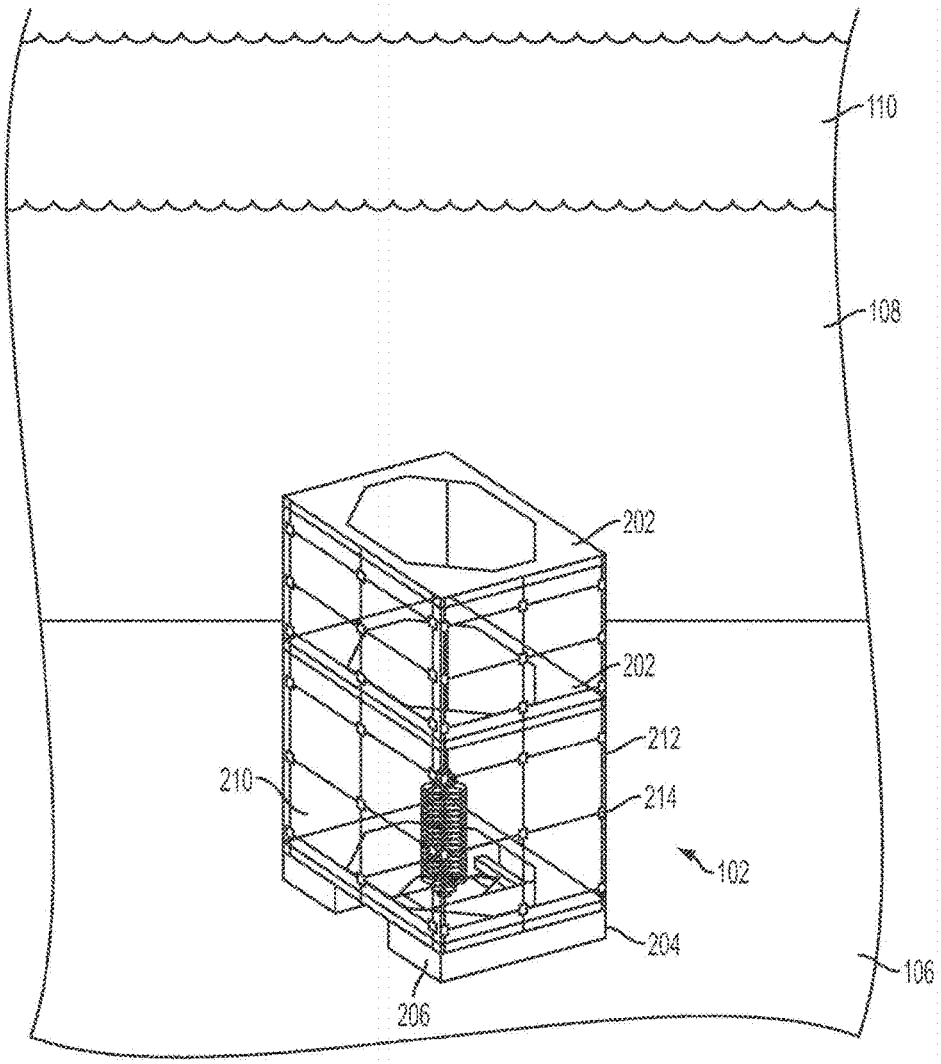
Figure 4:
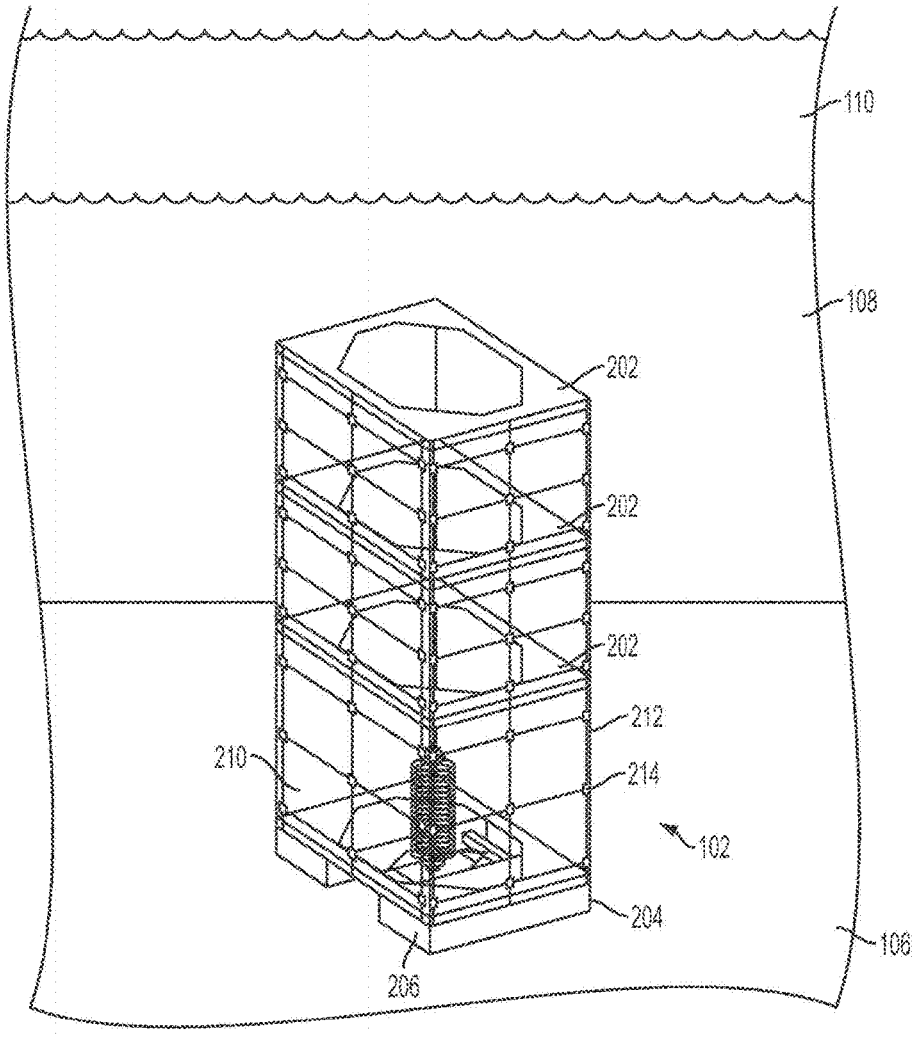
Figure 5:
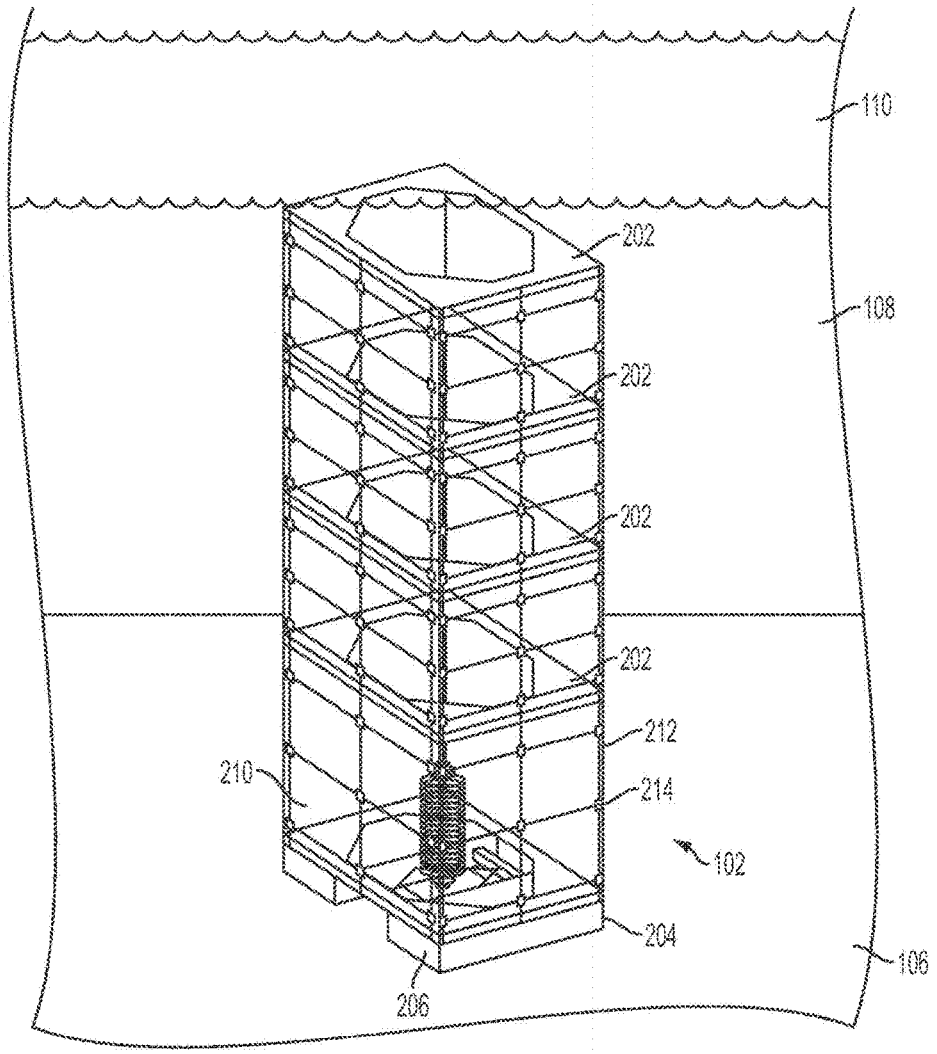

FIG. 3 shows the second flotation unit 202 released. FIG. 4 shows the third flotation unit 202 released. FIG. 5 shows the fourth flotation unit 202 released. A fifth flotation unit (not shown) is then deployed to reach 5,000 feet.

Figure 6:
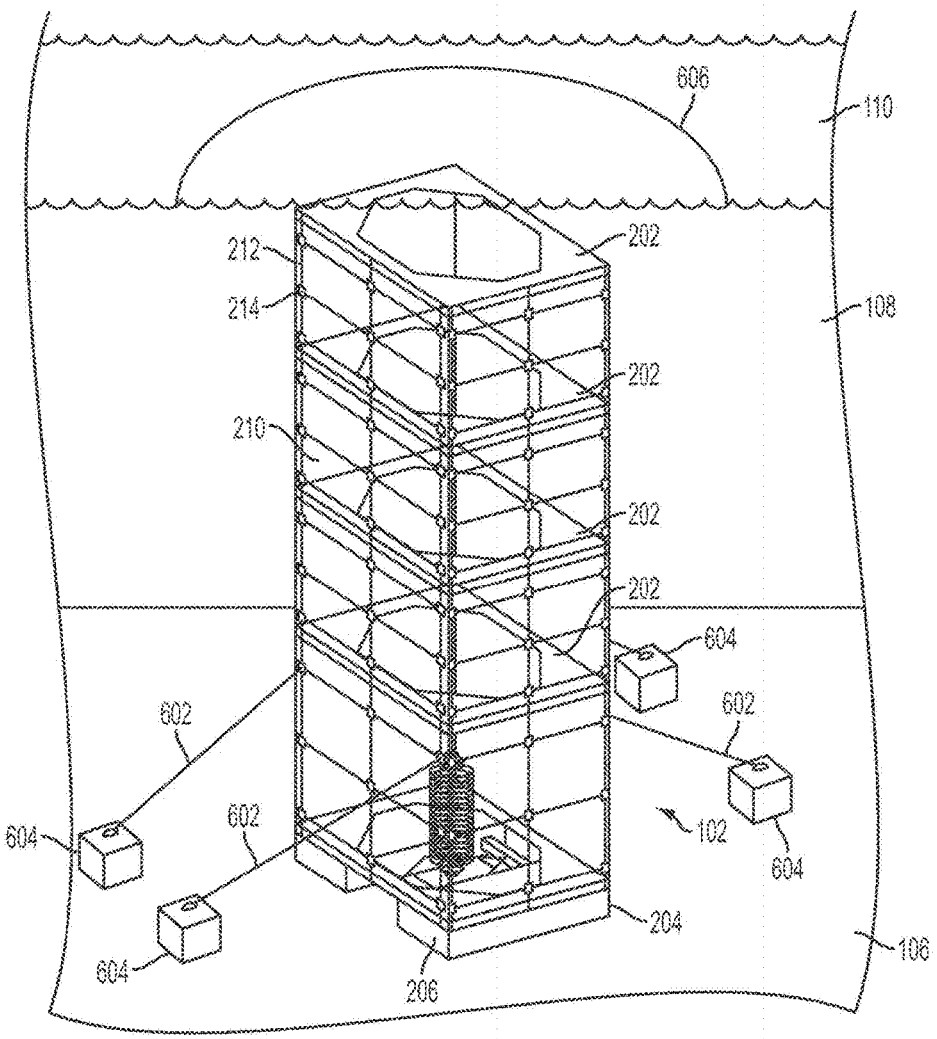
Figure 7A:
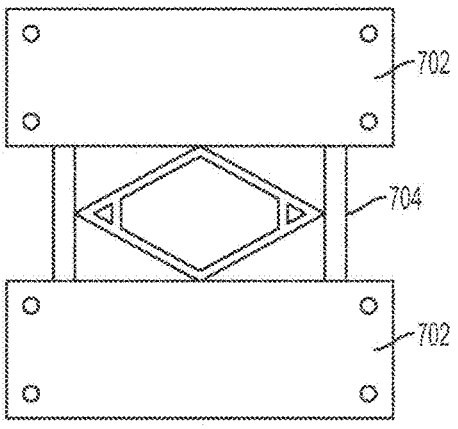
FIGS. 7A-7D together form a schematic representation of a flotation device or weighted base according to the first preferred embodiment.
Figure 7B:
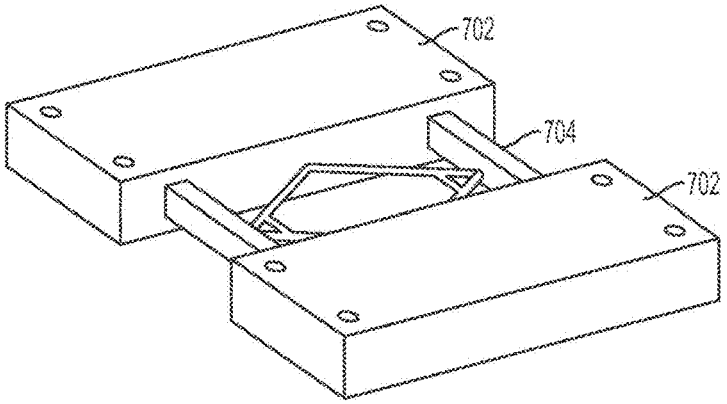
Figure 7C:
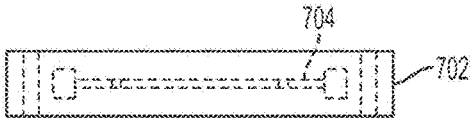
Figure 7D:
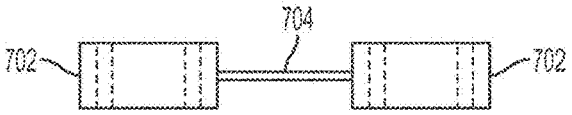

FIG. 6 shows the erected containment unit 102. Each flotation unit 202 is anchored by cables 602 to anchors 604 as necessary before the next flotation unit 202 is released. Flotation units up to 3,000 feet from the ocean floor 106 can be anchored to the ocean floor 106. Flotation units above 3,000 feet from the ocean floor 106 can be anchored to tugboats or barges. A barrier 606 such as an oil boom is placed around the top of the containment unit 102 on the ocean's surface 110.

FIGS. 7A-7D are top, perspective, first side, and second side views of a base unit or a flotation device. The two end pieces 702, which are formed of concrete for the base unit and of coated foam for the flotation devices, are connected by metal braces 704. Preferably, the metal is aluminum. Alternatively, the brace 704 is PVC filled with concrete. The coated foam is preferably about 8 feet thick and Styrofoam coated with plastic or rubber.

Figure 8A:
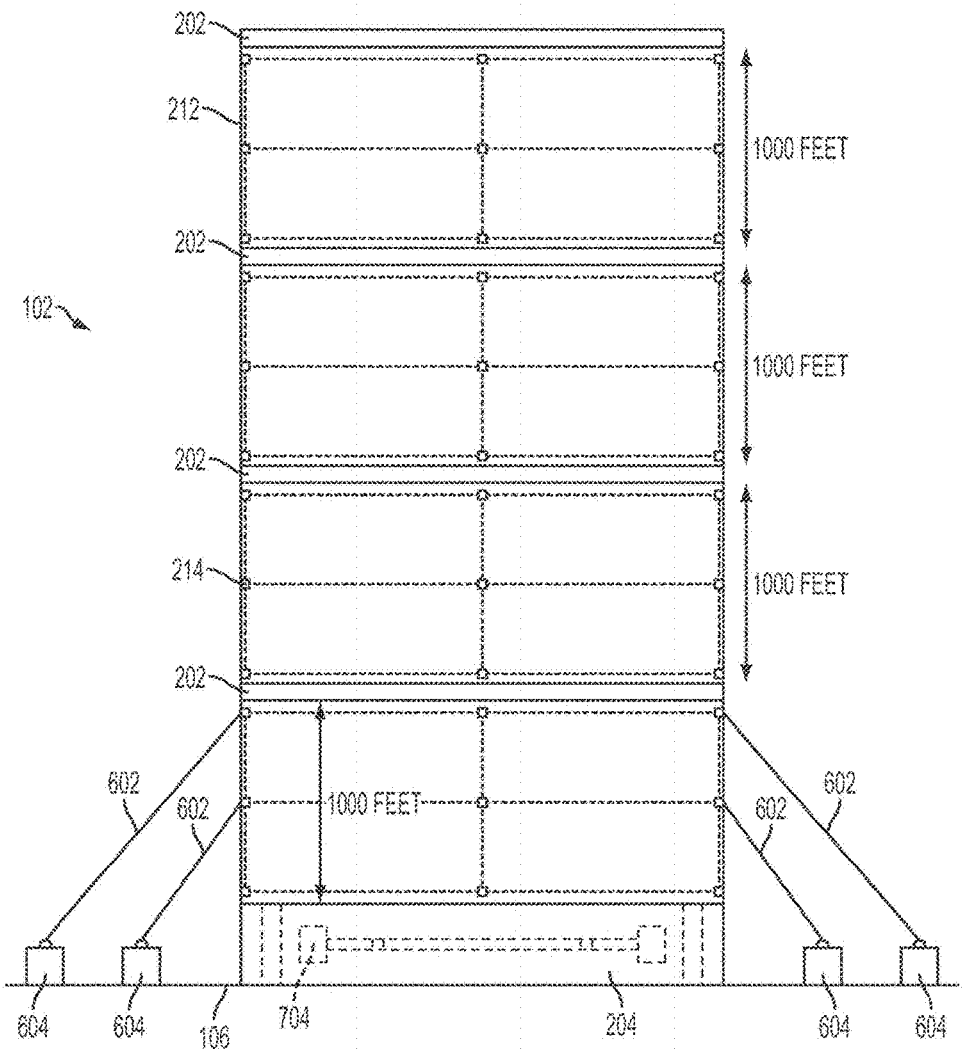
FIGS. 8A and 8B together form a schematic representation of an erected containment unit according to the first preferred embodiment.
Figure 8B:
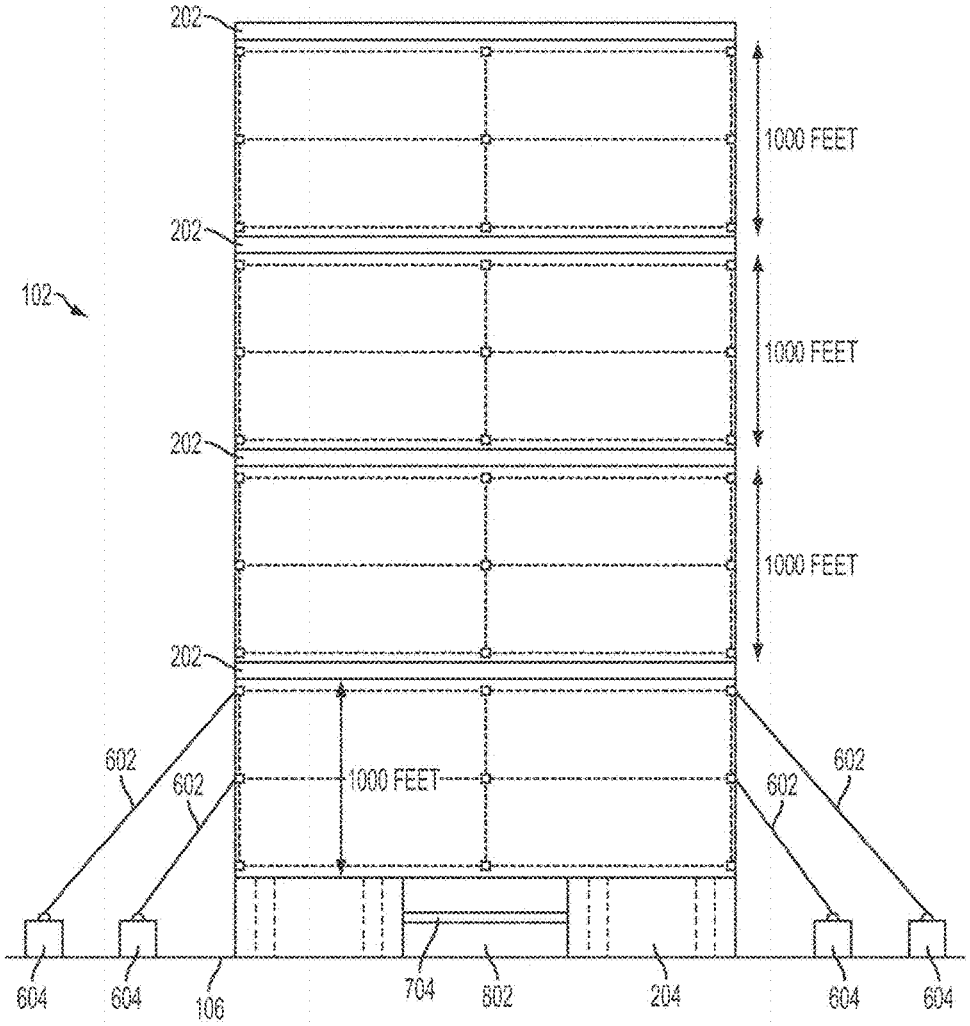

FIGS. 8A and 8B are two side views of a fully extended containment unit 102, showing the flotation units 202, the base unit 204, the reinforcing cables 602, and the concrete anchors 604 anchored to the ocean floor 106. The base unit 204 provides an opening 802 to allow sea water to enter the containment unit 102 to prevent freezing of the oil.

The containment unit is preferably made of flotation units 202 with barrier walls 210 comprising a synthetic fiber, preferably an aramid fiber material such as Kevlar or Twaron, reinforced with cable 212, with flotation units 202 at about 1,000-foot increments to form a stack or tower. Both the dimensions and the material are illustrative rather than limiting and can be determined by the circumstances. Alternatively, the walls 210 may be made of rubber. The flotation devices of the flotation units 202 are preferably braced with metal bars. The containment unit is preferably large enough to allow equipment to be deployed from the surface of the unit. More preferably, it can be used as a drafting tank, while protecting the environment.

The containment unit of the first embodiment is preferably made up of 4 flotation units and 1 anchor unit. Each flotation unit preferably has an inside diameter of 30×30 feet to accommodate a broken/damaged riser and Kevlar walls reinforced with rubber coated iron cables for frame support. The base unit is 2 to 4 tons and 20 feet high depending on the water depth. The containment unit may also be square, rectangle, oval or round.

The walls are preferably made of a layer of Kevlar with a rubber coated cable frame and then another coat of Kevlar for added strength. When attached to the flotation units that will become the containment unit, the cables comprise 20,000 feet of Kevlar and cable frame. Each flotation unit will rise 1,000 feet. While Kevlar is given as an illustrative example, any other suitable material can be used, as long as it is impermeable to oil, flexible, and not broken down by oil or salt water. Kevlar is considered a good choice because it can withstand salt water for long-term deployments.

The base unit serves as a platform and housing for the flotation units. All flotation units are stacked on top of the base unit and lowered to the ocean floor. Packing straps are released from the base unit to the top flotation unit, one at a time. Each section must be stabilized before moving to the next section at 1,000-foot increments. Preferably, all units are not released at once to avoid ripping of material and loss of control of the stacking process. The containment unit should be raised as straight as possible, but the pliable materials (Kevlar/cables) allow it to shift and sway with the movement of the ocean. Alternatively, the base unit could be made of clump weights and preinstalled.

An ROV is utilized to release each flotation unit starting from base unit. Drop anchor blocks with attached cables at strategic points are used for structural support. As the first flotation unit is released, it will rise up 1,000 feet from the base, with or without the additional use of lift bags or air bags. The first flotation unit may or may not need anchor lines for support. If so, anchors are attached before the second flotation unit is released. Then the second unit is released and the containment unit is raised another 1,000 feet, i.e., 2,000 feet total, and anchor blocks are attached with cables to the flotation unit. ROVs are used to anchor all 4 sides every 1,000 feet. Then the ROV releases the third flotation unit and anchors it at 3,000 feet on 4 sides. This method is used up to 3,000 feet. Barges or tug boats are used once the containment unit is 4,000 to 5,000 feet high.

At approximately 4,000 feet, anchor lines may be attached to barges or tug boats for additional support and stabilization of the units. At the surface of ocean, additional flotation units can be added to increase the height of the containment unit. An additional perimeter barrier such as an oil boom can be used around the surface containment section to capture any oil that may escape from the containment unit. As the riser loses pressure and oil flows to the surface, ships can draw oil from the surface inside the containment area.

The completed structure is high enough to contain the oil while necessary repairs are done without allowing oil to reach the shoreline. On that note, the unit is a "containment" unit and not a "tank"; i.e., sea water will flow into the unit through an opening in the concrete base, and the oil, via pressure, will push upwards to the surface for capture by barges/ships on the surface. Sea water is necessary in order to avoid freezing of the oil at such depths.

Preferably, the containment unit of the present invention is compressed for storage, such as by means of straps, preferably rubber or nylon straps. The packaging for deployment can include pulleys and other devices to prevent tangling of the cables. The cables themselves can be made out of metal, nylon, or any other material capable of withstanding the environment.

Figure 9:
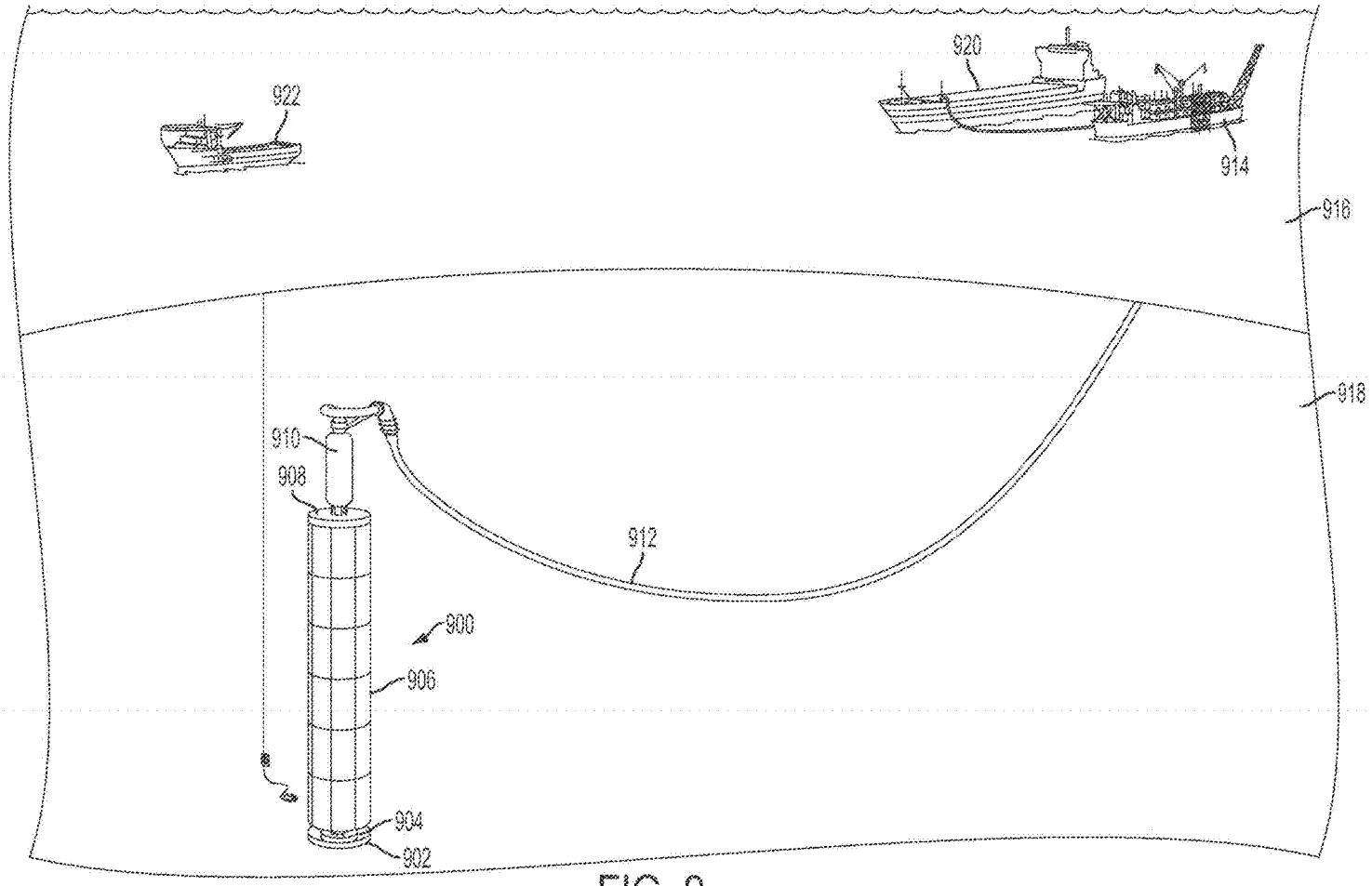
FIG. 9 shows a containment unit according to a second preferred embodiment with a ship in a body of water.

The second preferred embodiment is constructed and used like the first preferred embodiment, with the flotation unit lowered in the closed position over the riser or other equipment and the anchor unit, and opened up from the bottom to the top. The second preferred embodiment uses a storm cap and buoy to contain oil (or gas, etc.) in a Kevlar (or other suitable material) column to direct flow to a production vessel/tanker. More specifically, as shown in FIG. 9, in the containment unit 900, the base 902 is attached with rigging or attachment cables 904 to a column 906 topped by a flotation device 908. Oil reaching the top of the column 906 enters an oil collection unit or storm cap 910 and is taken via a hose 912, preferably a large diameter hose, to a capture/containment vessel or transfer ship 914 on the surface 916 of the body of water 918. The second preferred embodiment provides a safer environment for capture vessels to operate at a safer distance from possible gas collection above the well. The hose 912 provides the link between the containment unit 900 and the capture/containment vessels 914. Additional options include the ability to inject hydrate inhibitors or dispersants to ensure flow.

The storm cap 910 is a transfer tank that retains oil while allowing gas to escape. The containment unit 900 can be topped initially with a metal plate, which is then replaced with the storm cap 910 as necessary.

One advantage of the present invention over conventional techniques is that only three ships are required: a transfer ship 914, which separates oil from water; a tanker 920, which carries the oil to shore, and a deployment ship 922, which deploys the unit 900. The containment unit 900 can be conveyed in a closed position by the deployment ship 922 and then opened and installed from bottom to top. Another is that the storm cap 910 can be used at various locations depending on local conditions, including storms. For example, the storm cap 910 can be located at the least pressure point. The gap between the storm cap 910 and the water's surface 916, in combination with the use of the hose 912, will protect ships from explosions.

The second preferred embodiment provides for the containment and control of an oil spill caused by a damaged or faulty piece of subsea equipment in deepwater situations. The containment unit of the present invention is a cost-effective way to contain oil spills to a specific location and also allows the oil to be harvested as it flows to the top at the water surface, minimizing impact on the environment.

Figure 10A:
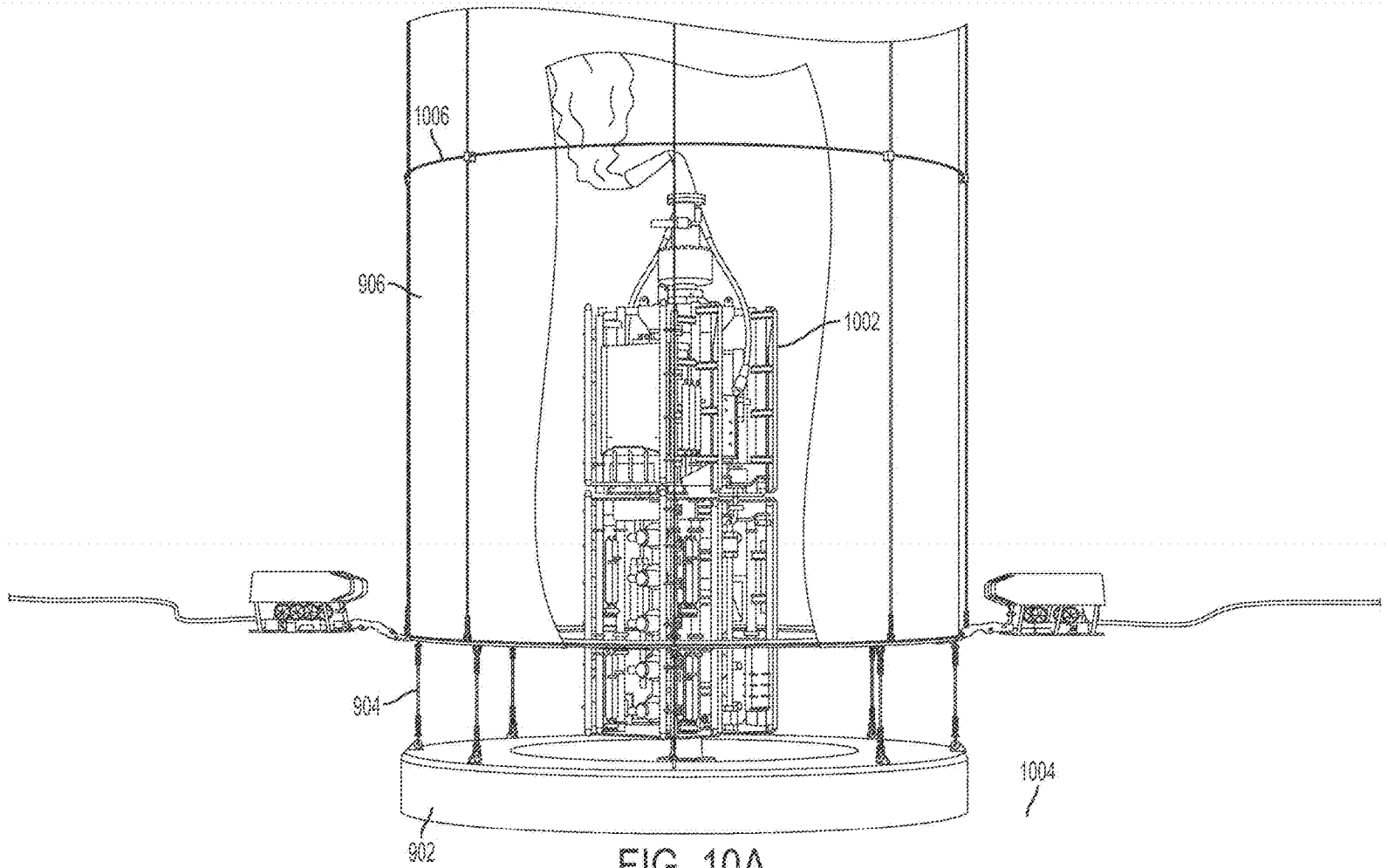
FIGS. 10A-10C are close-up views of variations of the containment unit according to the second preferred embodiment.

The unit 900 itself is comprised of two major components. The first is a weighted base 902 measuring approximately 30 feet in diameter, preferably circular. The unit can also have different shapes to best suit the need of a specific situation. The base is made of concrete and embedded structural beams. Its purpose is to provide an anchor for the rest of the components to function properly. The unit 900 is deployed over a leaking structure 1002, such as a blowout preventer (BOP), on or near the seabed 1004 as shown in FIG. 10A.

The second piece of the unit is a section of barrier composed of a flotation device 908 at the top of an encompassing perimeter 906 made of Kevlar or other such material which extends down from the flotation unit 1,000 feet. The sections are connected topside before deployment. The number of sections needed depends on the water depth on location, one section per 1,000 feet water depth. There are numerous ways to install and customize the above components to facilitate installation in adverse conditions such as high currents and well pressure. A guide by wire system may be used to attach barrier components to the concrete base. Provisions can also be made to supply enough mooring points to the overall unit to withstand currents and vibrations. This can be done with clump weights, a partial ring or other available methods to obtain stability.

The Kevlar or other material provides an insulating column that acts as a barrier to keep the environment safe. The material is preferably light-weight to maintain stability during deployment and recovery. As seen in FIG. 10A, wire rope runners 1006, used as reinforcements, are attached from the top of the unit to the base concrete ring or a series of clump weights. The concrete ring or series of clump weights provides the needed weight to keep the containment unit in place, withstanding ocean currents and other forces. Adjustable, heavy-duty rigging 904 anchors the column 906 to the base 902. The rigging is adjustable, allowing greater flexibility in terms of ROV access to the BOP and maximizing containment.

Figure 10B:
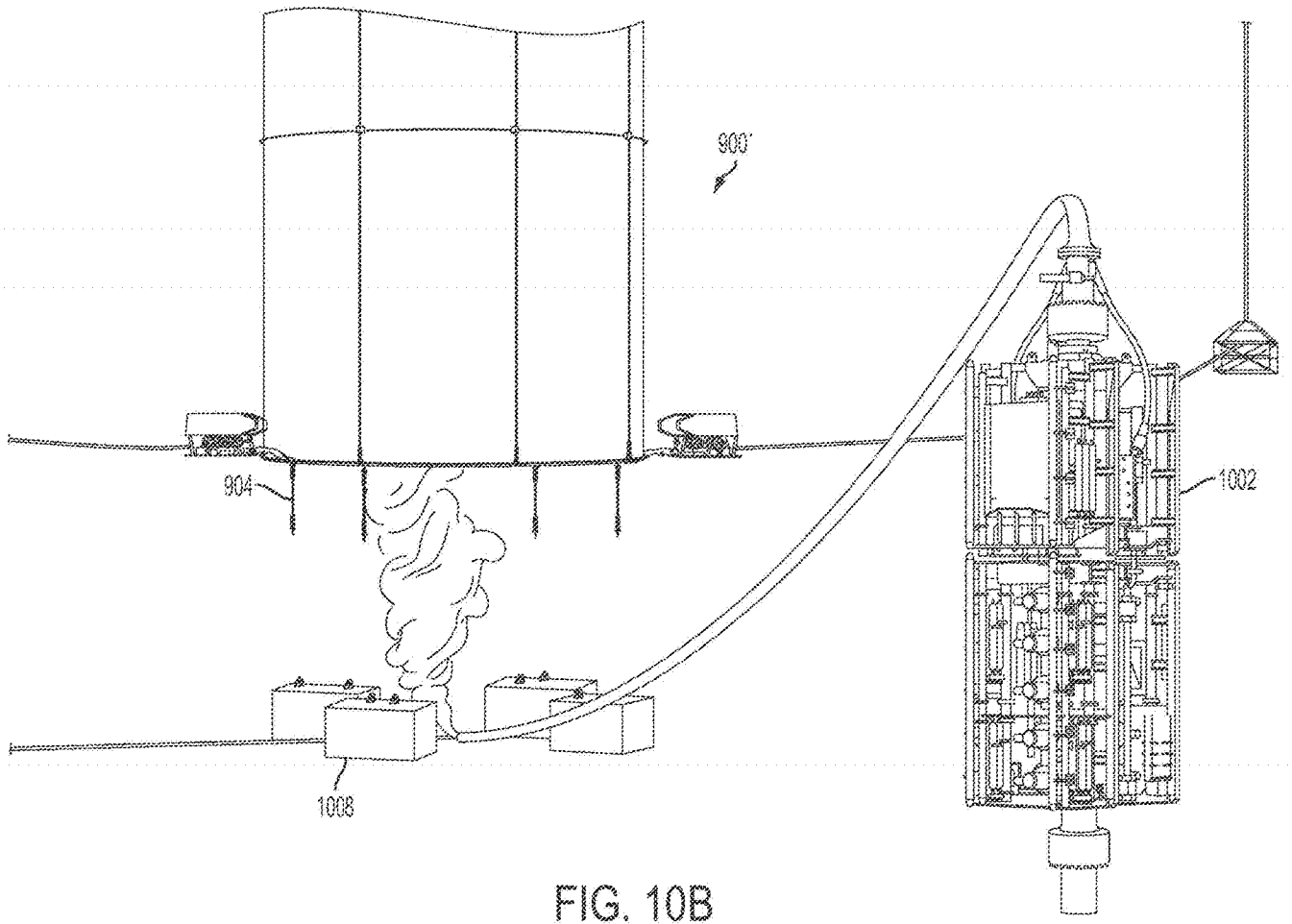
Figure 10C:
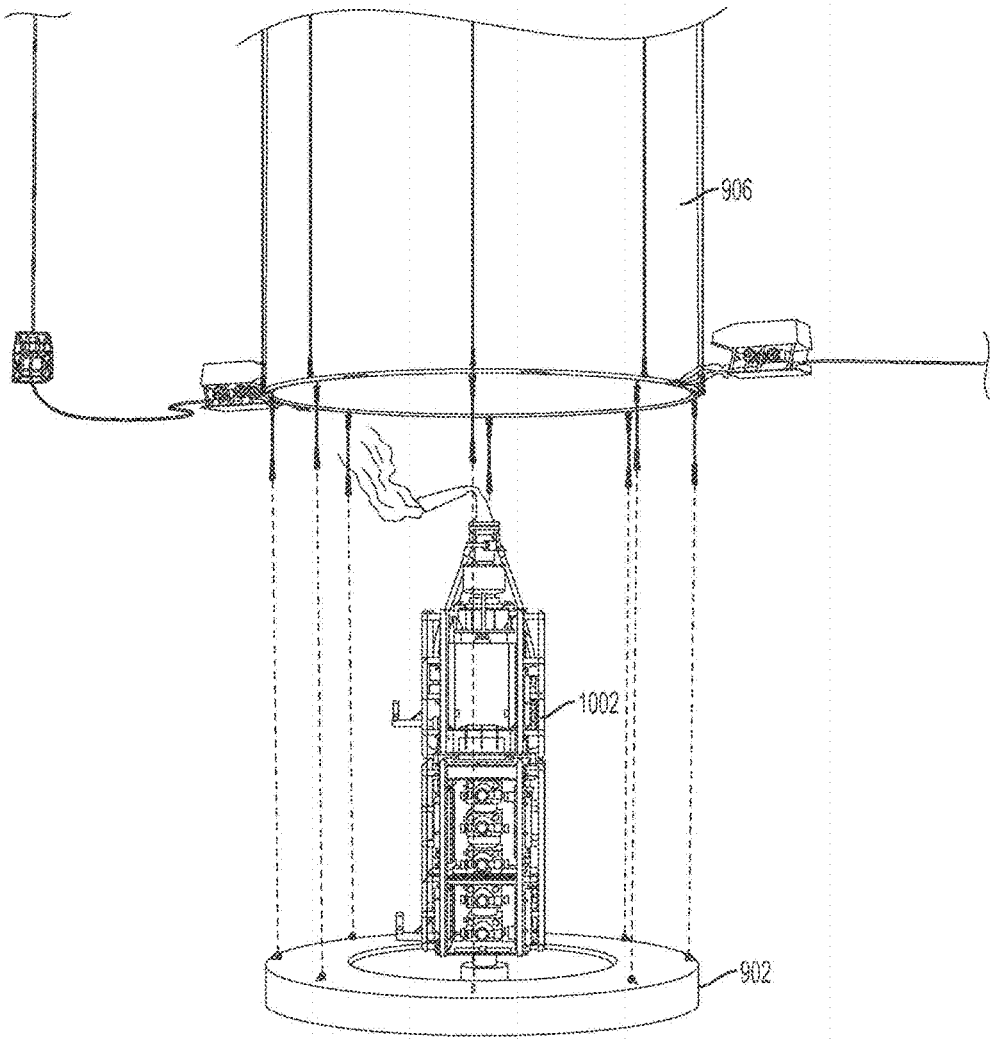
Figure 11:
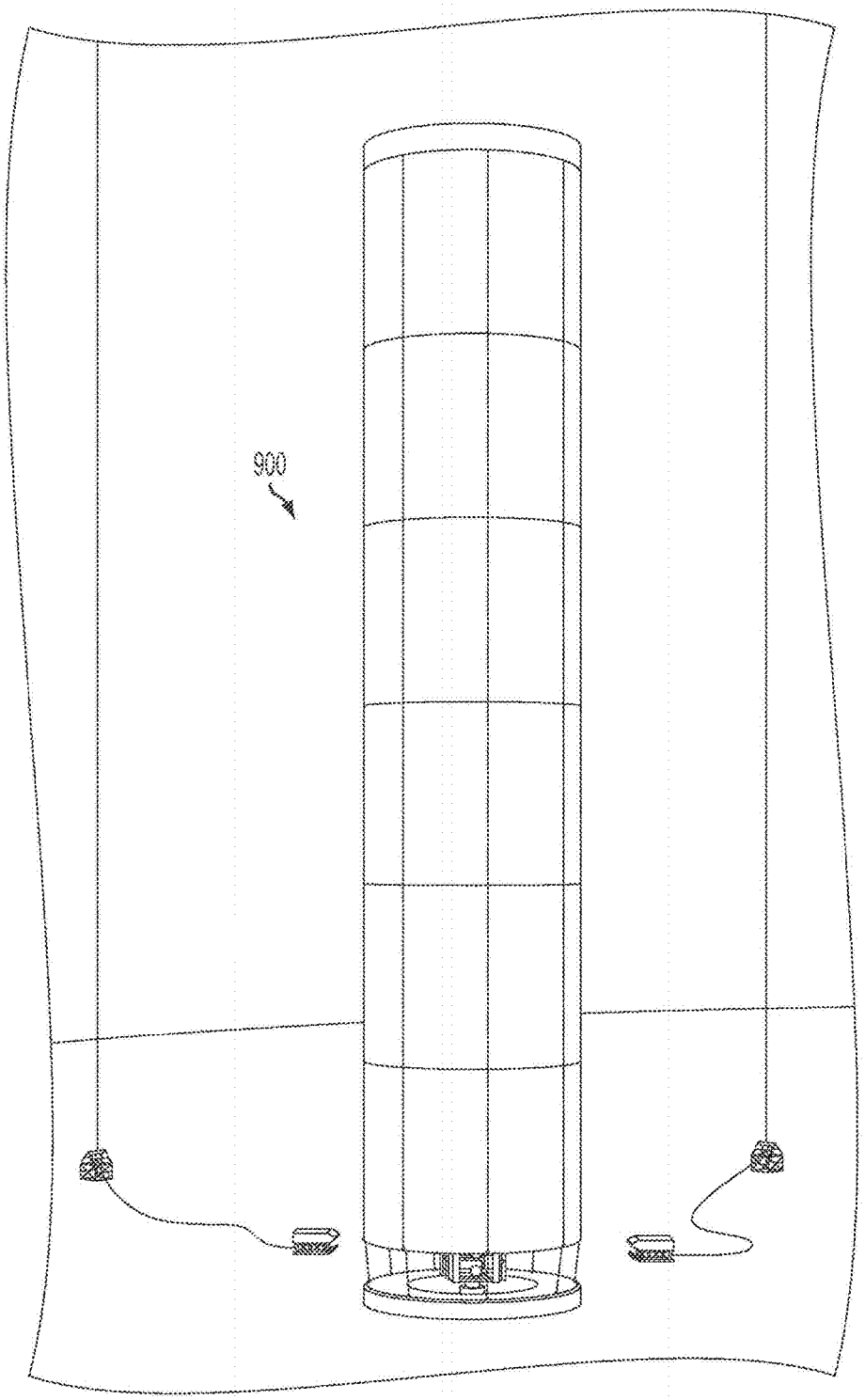
FIG. 11 shows the containment unit according to the second preferred embodiment in position.

FIG. 10B shows a smaller diameter structure 900' used for a leaking riser (small diameter leak) with clump weights or a partial ring 1008. FIG. 10C shows a containment column 906 being lowered onto a BOP. FIG. 11 shows the containment unit 900 in position.

The structure of the second embodiment provides:

- A sturdy concrete base that can be preinstalled before disaster strikes;
- A quick response deep sea containment structure;
- A safe solution to containment and control of an oil spill caused by a damaged or faulty piece of subsea equipment in deepwater situations;
- A cost-effective method to contain oil spills to a specific location; and
- The ability to harvest the oil as it flows to the top at the water surface, minimizing impact on the environment.

In either of the preferred embodiments, or in any other embodiment, variations on the flotation device are possible.

For example, lift bags can be used for quick erection, and the flotation devices are then used to keep the containment unit upright and erected. Although foam is preferred for the flotation devices because of its stability for long-term deployment in various environments, other suitable materials as would be known to one of skill in the art may also be used. Preferably, the foam should be able to provide sufficient lift, e.g., 1,000 lbs, to keep the containment unit upright. In addition to the flotation devices that are permanently mounted to the inside of the barrier at 1,000-foot increments, additional flotation devices may be added to the exterior of the barrier, i.e., flotation donuts. These flotation donuts may be fixed to the outside of the barrier or may be movable, i.e., they can be fixed to the exterior of the barrier during manufacture or during deployment. Also, the spacing can be varied; for example, the external (donut) flotation devices can be placed every 500 or 800 feet as the conditions warrant. In addition, the weighted base can be replaced by, or supplemented with, an anchoring scheme in which pins are shot into the mud at the sea floor.

Having now described a few embodiments of the invention, it should be apparent to those skilled in the art that the foregoing is merely illustrative and not limiting, having been presented by way of example only. Numerous modifications and other embodiments are within the scope of the invention and any equivalent thereto. It can be appreciated that variations to the present invention would be readily apparent to those skilled in the art, and the present invention is intended to include those alternatives.

Further, since numerous modifications will readily occur to those skilled in the art, it is not desired to limit the invention to the exact construction and operation illustrated and described, and accordingly, all suitable modifications and equivalents may be resorted to as falling within the scope of the invention. For example, numerical limitations are illustrative rather than limiting, as are recitations of particular materials. Also, the invention can be used to contain any leak of a material into an ambient fluid, in which the ambient fluid can be water, air for land-based uses, or the like. Therefore, the present invention should be construed as limited only by the appended claims.

What is claimed is:

1. A containment unit for containing a leak of a material into an ambient fluid, the containment unit comprising:

a weighted base for being disposed around the leak wherein the weighted base is rectangular and comprises first and second end pieces and braces connecting the first and second end pieces to one another, the first and second end pieces being spaced apart from one another to provide an opening configured to allow the ambient fluid to enter the containment unit, flow through the containment unit, and comingle with the material;

a flotation unit attachable to the weighted base, the flotation unit comprising a flotation device and a barrier wall; and one or more additional flotation units attachable to and stackable on the flotation unit, the additional flotation units comprising additional flotation devices and additional barrier walls configured to contain the material;

wherein the flotation device and the additional flotation devices comprise coated foam supported by a brace and have identical rectangular shape as the weighted base.

2. The containment unit of claim 1, wherein the containment unit is reusable.

3. The containment unit of claim 1, wherein the base comprises reinforced concrete supported by a brace.

4. The containment unit of claim 3, wherein the brace is metal.

5. The containment unit of claim 4, wherein the metal is aluminum.

6. The containment unit of claim 3, wherein the brace is PVC filled with concrete.

7. The containment unit of claim 1, wherein the brace is metal.

8. The containment unit of claim 7, wherein the metal is aluminum.

9. The containment unit of claim 1, wherein the brace is PVC filled with concrete.

10. The containment unit of claim 1, wherein the coated foam is Styrofoam coated with plastic or rubber.

11. The containment unit of claim 1, wherein the barrier walls and the additional barrier walls are flexible.

12. The containment unit of claim 1, wherein the barrier walls and the additional barrier walls comprise Kevlar or rubber.

13. The containment unit of claim 1, wherein the barrier walls and the additional barrier walls are reinforced.

14. The containment unit of claim 13, wherein the barrier walls and the additional barrier walls are reinforced with rubber coated cables or solid PVC piping.

15. The containment unit of claim 1, further comprising a storm cap.

16. The containment unit of claim 1, wherein the containment unit is a transfer tank.

17. The containment unit of claim 16, wherein the base is open.

18. The containment unit of claim 17, wherein a top of the containment unit is enclosed.

19. A method of using the containment unit of claim 1, the method comprising:

deploying the containment unit to an ocean floor over a broken riser while the flotation unit and the additional flotation units are in a first, compressed position;

releasing the flotation unit;

releasing the additional flotation units sequentially until an ocean surface is reached; and anchoring the flotation unit and the additional flotation units as necessary before releasing a subsequent one of the additional flotation units.

20. A method of using the containment unit of claim 1, the method comprising:

providing the weighted base around the leak;

assembling the flotation unit and enough of the additional flotation units together to account for a depth of the ambient fluid; and anchoring the flotation unit and additional flotation units to the base.

21. The containment unit of claim 1, wherein the flotation unit and the additional flotation units have identical configurations to one another.

22. The containment unit of claim 1, wherein the flotation unit and the additional flotation units are sequentially releasable from compressed states into erected states at different respective depths of the ambient fluid.

* * * * *